US005163781A

United States Patent [19]

Husu

[11] Patent Number: 5,163,781

[45] Date of Patent: Nov. 17, 1992

[54] FIELD CONSTRUCTION FOR A SPORTS OR OTHER FIELD

[76] Inventor: Aarne Husu, Vattuvuorenkatu 1, SF-78200 Varkaus, Finland

[21] Appl. No.: 623,443

[22] PCT Filed: Jun. 16, 1989

[86] PCT No.: PCT/FI89/00119

§ 371 Date: Dec. 4, 1990

§ 102(e) Date: Dec. 4, 1990

[87] PCT Pub. No.: WO89/12719

PCT Pub. Date: Dec. 28, 1989

[30] Foreign Application Priority Data

Jun. 20, 1988 [FI] Finland ..... 882931

[51] Int. Cl.[5] ..... E02B 11/00

[52] U.S. Cl. ..... 405/43; 405/36; 405/45

[58] Field of Search ..... 405/36, 37, 43, 131, 405/38, 45, 48

[56] References Cited

U.S. PATENT DOCUMENTS 632,388 9/1899 Whitehead ..... 405/131
1,967,803 7/1934 Boland ..... 405/131 X
3,908,385 9/1975 Daniel et al. ..... 405/38 X
4,268,993 5/1981 Cunningham ..... 405/37 X
4,462,184 7/1984 Cunningham ..... 405/37 X
4,620,398 11/1986 Wallin ..... 405/131 X
4,881,846 11/1989 Burkstaller ..... 405/38 X
4,913,596 4/1990 Lambert ..... 405/36 X

FOREIGN PATENT DOCUMENTS 1347965 2/1974 United Kingdom ..... 405/131

*Primary Examiner*—Dennis L. Taylor
*Attorney, Agent, or Firm*—Brooks & Kushman

[57] ABSTRACT

A field construction for sports or other fields is disclosed which includes a substrate or other surface layer and also a filter layer having a pipe network (2,3). The pipe network (2,3) comprises numerous perforated multi-purpose pipes (3) to dry the field and to lead air through the field. In the filter layer (4), the proportion of fine material or material having a granular size of less than 0.06 mm is less than 5%; most advantageously the proportion is less than 1%, so that the filter layer is highly permeable to air, and the substrate includes so much fine material that is less permeable to air.

7 Claims, 4 Drawing Sheets

FIELD CONSTRUCTION FOR A SPORTS OR OTHER FIELD

CROSS-REFERENCE TO RELATED APPLICATION

This invention is particularly useful in connection with playing fields of the type described in U.S. patent application Ser. No. 522,255, filed May 11, 1990 now U.S. Pat. No. 5,120,158, which is hereby incorporated by reference.

TECHNICAL FIELD

This invention relates to a field construction for a sports or other field, which includes a substrate or other surface layer, and beneath this, a filter layer which is equipped with perforated multi-purpose pipes to dry the field and to lead air through it.

BACKGROUND ART

In field-drains in the grass-covered areas of sports facilities, the distance between the drains varies from 8–10 meters. Uneven drying can be observed at present on many fields. At 2–4 meters from the line of the drain the field is considerably drier than in the areas between the drains.

Fields equipped with various kinds of piping are presented in the German application and Patent Publications DE-P-924931, DE-2059383, DE-H-27 38 133, and DE-H-2840389. By means of a network of pipes beneath the surface of the field it is both warmed, and dried by draining excess water into field-drain soakaways. The warming of the field takes place by blowing warmed air into the pipe network, from which it travels upwards to the surface of the field. The problem with the above-mentioned field constructions is firstly the unevenness of the blowing if the network of pipes is not very dense. Secondly, the back and forwards flow causes fine material substances to enter the known field pipes.

The use of electrical resistances or heating pipes in the surface of a sports field is also known, these both warming and drying the surface of the field. The distance between the resistances or pipes has been only about 20 cm, which has led to an enormous total length of resistance cables and heating pipes.

SUMMARY OF THE INVENTION

An object of the present invention is to achieve a new field structure, which makes possible efficient use of a pipe network for both drying and heating and by means of which this is possible using a greater space between pipes than previously.

In carrying out the above object and other objects of the invention, the field construction includes a substrate or other surface layer and a filter layer having a pipe network located therein beneath the surface layer. In accordance with the invention, the pipe network is placed in the filter layer in which the proportion of fine mineral substances is small, so that the flow of heating air within this layer in a horizontal direction is also possible. The pipe network does not then have to be unreasonably dense.

In the preferred embodiment, the surface layer comprises a layer of fine material of which at least 15% of the mass has a granular size of less than 0.06 mm. The substrate is adapted in each individual case to have poor air permeability. Depending on the type of soil the proportion of fine mineral substances may vary greatly.

In what follows the invention is illustrated by means of examples with reference to the accompanying figures, which shows one form of the application of the invention in connection with a turf field of about 8000 $m^2$ intended for ordinary sports use.

BEST MODE FOR CARRYING OUT THE INVENTION

Figure 1:
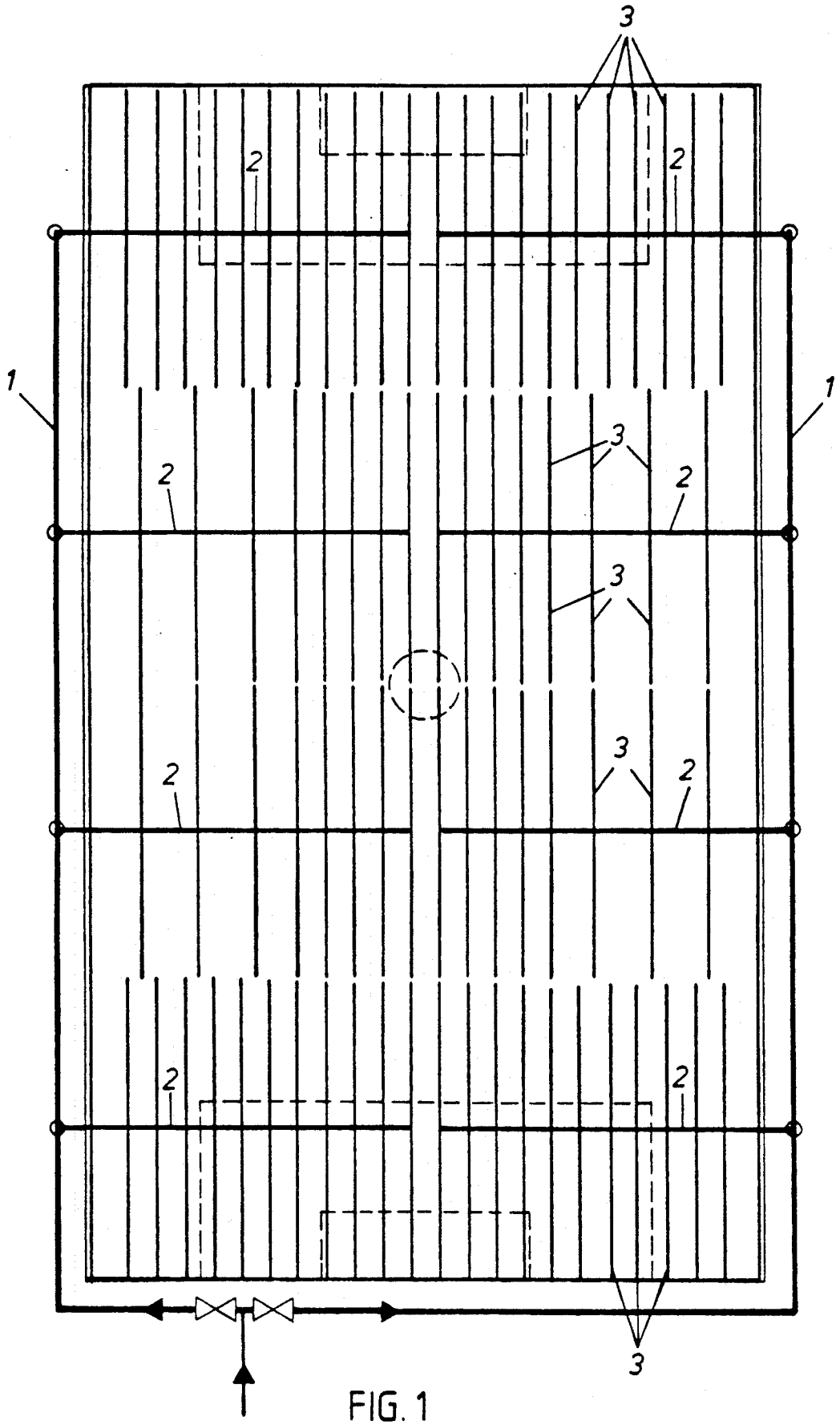
FIG. 1 is a schematic plan view of a sports field illustrating the location of a pipe network in the field.
Figure 2:
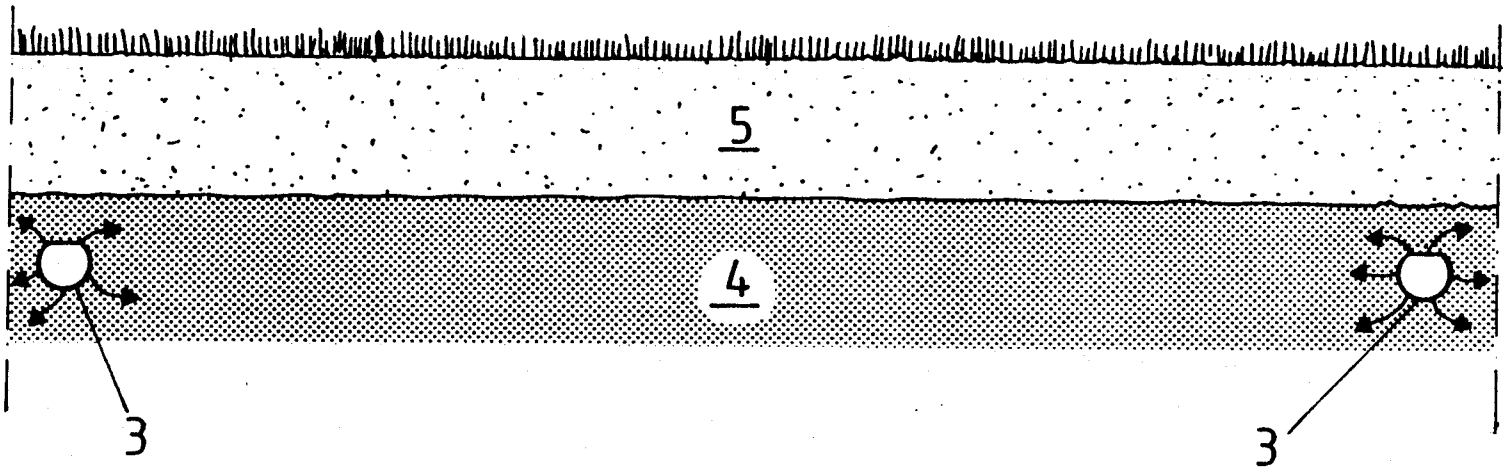
FIG. 2 is a sectional elevational view of a part of the sports field illustrating the field construction.

With reference to FIGS. 1 and 2, a pipe network 2,3 is located beneath the surface 5 of the ground that defines a sports field. Main pipes 1 are located at the side of the field and are connected to extension pipes 2 that extend to the center of the field. The multi-purpose pipes 3, which are connected to pipe 2 act as field drains providing air-distribution in one direction and watering pipes in the other direction.

The substrate or surface 5 of the field turf is fairly conventional. It is formed, however, of a layer 5, which is clearly separate from a subsurface or filter layer 4. In addition, the layer of the substrate 5 is selected from soil having such a great proportion of fine material that it gives rise to a powerful capillary effect, by means of which the roots of the plants get water from the filter layer 4. Both layers, 4 and 5, are about 20 cm thick.

If a further separate damping layer is used beneath the turf, the hardness of the surface can be adjusted as required in each individual case.

The pipe network 2,3 is located in the filter layer 4, in which the proportion of fine material is very small. The blown air, and the warmth and moisture in it, is thus permitted to also travel in a horizontal direction, in which case the multi-purpose pipes 3 can be located at a reasonable distance of about 1.5–2.5 m from one another. On account of this, there does not need to be more than 3000–4000 m of multi-purpose piping in a normally sized sports field, whereas the requirement would have been about 30,000 m if electrical heating resistance or liquid circulation pipes were used.

Figure 3:
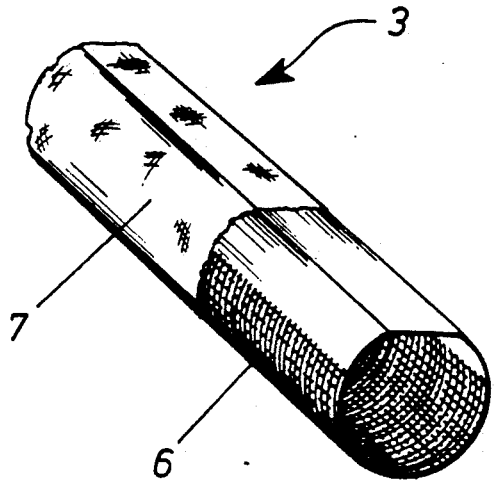
FIG. 3 is a perspective view of a portion of a multi-purpose pipe illustrating its construction.

As seen in FIG. 3, the multi-purpose pipes 3 are advantageously manufactured from conventional perforated field-drain pipes, on top of which a plastic filter screen 7 is placed. This prevents the fine material from entering the pipe and thus blocking it.

In a field construction of this kind, watering can be carried out as either spray watering or damming watering. Spraying is carried out together with blowing, whereas in damming watering, the pipe network is filled directly with water.

The field construction in accordance with the present invention is intended for use during the entire growing season. In summer, it can be used for both watering the field and for draining excess water into field-drain soakaways. For example, by means of the known electrical heating, the field heating is used only in the spring and autumn.

Figure 4:
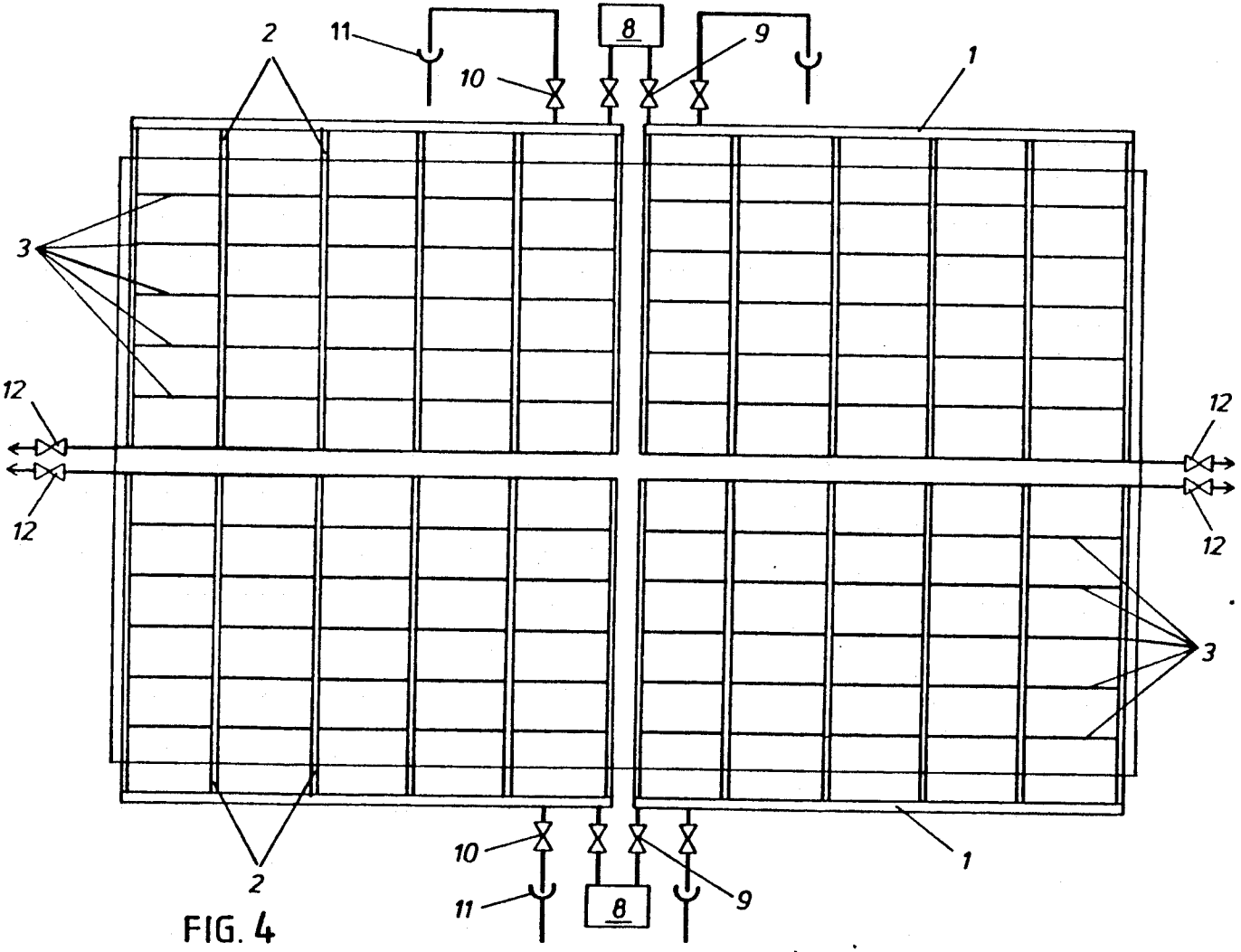
FIG. 4 is a schematic plan view of a sports field illustrating an alternative pipe network embodiment.

FIG. 4 illustrates an alternative field structure. Here in a field of normal size, the pipe network comprises two pipe arrays on each side of the field. The arrays are operated by apparatus 8 arranged on both sides of the field. In these arrays, the flow is directed to the main pipe 1 at both sides of the field through a main control valve 9. By means of these control valves 9, the full power of the blowing or watering can be directed to one array, if required. Naturally, it is possible to realize the blowing by means of only one blowing apparatus.

With continued reference to FIG. 4, the main pipe 1 is of a diameter of 400 mm and branches into distribution pipes 2 of a diameter of 160 mm beneath the field. From distribution pipes 2 branch numerous multi-purpose 50 mm diameter pipes. By using a network structure of this kind with a filter layer 4 that is highly permeable by air, several advantages are achieved. The network structure increases operational dependability and makes it possible to reduce the diameter of the multi-purpose pipes to one half of that in a branch structure.

In both embodiments of the playing field, it is quite essential that the surface layer 5 causes great air resistance. Due to the heating, drying or watering, the air permeability of the filter layer 4 should be 3–4 times as great as that of the surface layer 5.

While the best mode for carrying out the invention has been described in detail, those familiar with the art to which this invention relates will recognize various alternative designs and embodiments for practicing the invention as defined by the following claims.

What is claimed is:

1. A field construction for sports or other fields comprising:

a substrate or other surface layer, a filter layer beneath said surface layer including fine material substances, said filter layer including a pipe network which includes numerous perforated multi-purpose pipes to dry the field and conduct air through the field, characterized in that the thickness of the filter layer is between 15–25 cm and the thickness of the substrate layer is between 15–25 cm, the multi-purpose pipes are located at a distance of between 1.5–2.5 m from one another, and the specific permeability of the filter layer is at least 2.5 times as great as that of the substrate layer.

2. A field construction as in claim 1 characterized in that the proportion of fine material substances of a granular size of less than 0.06 mm in the filter layer is less than 5% to permit a good flow of air therethrough.

3. A field construction as in claim 2 characterized in that the portion of the fine material substances of a granular size of less than 0.06 mm in the filter layer is less than 1%.

4. A field construction as in claim 1 characterized in that the multi-purpose pipes are composed of field drain pipes which are covered with fabric mesh.

5. A field construction as in claim 1 characterized in that the substrate is formed of a separate layer on top of a filter layer, and that the proportion of fine material, having a granular size less than 0.06 mm, of the mass of the substrate, is more than 15%.

6. A field construction as in claim 1 characterized in that the pipe network located in the filter layer is formed of a network of distribution and multi-purpose pipes in which each multi-purpose pipe crosses several transverse distribution pipes.

7. A field construction as in claim 1 wherein the specific permeability of the filter layer is 3 to 4 times as great as that of the substrate layer.

* * * * *